United States Patent [19]

Uozumi et al.

[11] Patent Number: 4,730,592

[45] Date of Patent: Mar. 15, 1988

[54] OUTER VENT CONTROL DEVICE FOR A CARBURETOR

[75] Inventors: Yasuji Uozumi; Hitoshi Yamabe, both of Saitama; Sachito Fujimoto, Tokyo; Hideo Kobayashi, Saitama, all of Japan

[73] Assignee: Honda Giken Kogyo Kabushiki Kaisha, Tokyo, Japan

[21] Appl. No.: 843,045

[22] Filed: Mar. 24, 1986

[30] Foreign Application Priority Data

Mar. 26, 1985 [JP] Japan ..... 60-42350[U]

[51] Int. Cl.[4] ..... F02M 33/02

[52] U.S. Cl. ..... 123/516; 123/520

[58] Field of Search ..... 123/516, 519, 520

[56] References Cited

U.S. PATENT DOCUMENTS

| | | | |
|---|---|---|---|
| 4,191,154 | 3/1980 | Shibata | 123/519 |
| 4,258,685 | 3/1981 | Arai | 123/520 |
| 4,432,328 | 2/1984 | Shimizu | 123/520 |
| 4,577,607 | 3/1986 | Nishio | 123/516 |

FOREIGN PATENT DOCUMENTS

| | | | |
|---|---|---|---|
| 54-148932 | 11/1979 | Japan | 123/519 |

*Primary Examiner*—Ronald B. Cox

*Attorney, Agent, or Firm*—Lyon & Lyon

[57] ABSTRACT

An outer vent control device for use with a carburetor includes a valve housing adapted to be attached to the outer wall of a float chamber in thermally conductive relation, a first control valve disposed in the valve housing and openable when the engine stops its operation, and a second thermosensitive control valve disposed in the valve housing and closable when the temperature of the float chamber drops below a preset temperature. The second thermosensitive control valve includes a thermosensitive unit and a cover attached to a valve housing thereof in covering relation to the thermosensitive unit. The second thermosensitive control valve also has a valve seat member with a valve seat disposed in the valve housing and a valve body movably disposed in the valve housing and seatable on the valve seat. The valve body has an upper conical surface facing an inlet port remotely from the valve seat. The cover has a ventilation hole defined in the bottom thereof at a lowermost position thereon.

6 Claims, 6 Drawing Figures

OUTER VENT CONTROL DEVICE FOR A CARBURETOR

The present invention relates to an outer vent control device for controlling the flow of fuel vapor from the float chamber of a carburetor to a canister through an outer vent line.

As disclosed in Japanese Laid-Open Utility Model Publication No. 55(1980)-156239 and U.S. Pat. Nos. 4,208,997 and 4,275,696, prior outer vent control devices for use with automotive carburetors comprise a first control valve disposed in an outer vent line and openable when the engine stops its operation, and a thermosensitive second control valve disposed in the outer vent line in series with the first control valve and closable when the temperature of the engine is lower than a certain preset temperature. Fuel evaporation from the float chamber is low at the time the engine temperature is low. Therefore, when the engine is colder than the preset temperature, the second control valve remains closed to keep the fuel vapor within the carburetor even if the engine is at rest, i.e., the first control valve is open. The fuel vapor kept in the carburetor enables the engine to be started quickly and smoothly at a later time. The second control valve is disposed on a coolant jacket so as to be responsive to the temperature of the engine coolant.

The conventional outer vent control devices suffer from certain drawbacks. Since the outer vent line is required to pass through the second control valve on the coolant jacket, the piping of the outer vent line is complex in arrangement. Where a second control valve is to be added to an existing outer vent control device having a first control valve only, the area where the second control valve is to be mounted and the outer vent line piping must be substantially redesigned, involving an increase in the cost. Another problem arises from the fact that the temperature of the coolant is not necessarily equal to the temperature of the float chamber. If the temperature of the float chamber drops more rapidly than the coolant temperature at the time the engine is stopped, then more fuel vapor is permitted by the second control valve to flow from the float chamber into the canister than required until the second control valve is closed in response to the coolant temperature reaching the preset temperature.

The second thermosensitive control valve comprises a tubular valve housing and a disc-shaped valve body axially reciprocally movable in the tubular valve housing, as disclosed in Japanese Laid-Open Patent Publication No. 54(1979)-45427. The valve housing has an inlet port defined in one end thereof and an outlet port defined in a side of the other end thereof. The valve body has an engaging surface seatable on a valve seat disposed in the valve housing between the inlet and outlet ports and facing the inlet port. The valve body is connected by a piston rod to a thermosensitive unit containing a mass of thermowax. When the thermosensitive unit reaches a preset temperature, the piston rod is moved by expansion of the thermowax to lift the valve body off the valve seat for thereby opening the passage between the inlet and outlet ports. The valve body has a flat surface axially remote from the engaging surface seatable on the valve seat, the flat surface facing the upstream side of the valve body. The flat surface of the valve body presents a large resistance to the flow of the fuel vapor, which imposes an increased back pressure on the valve body. Consequently, the valve body cannot be displaced quickly when it is lifted off the valve seat. In addition, the flat surface of the valve body tends to reduce the effective area of a valve opening which is produced when the second control valve is opened and through which the fuel vapor flows. These shortcomings manifest themselves in the thermosensitive control valve.

The thermosensitive unit is protected by an air-tight cover which prevents the thermosensitive unit from being adversely affected by the atmosphere surrounding the second control valve. As the temperature of air trapped in the engine compartment in which the carburetor with the second control valve is disposed goes higher, the difference between the temperatures of the interior and exterior of the cover becomes so wide that moisture in the cover is condensed on the surface of the thermosensitive unit. Air in the cover is thermally expanded to press the body of thermowax contained in the thermosensitive unit to thereby improperly actuate the unit.

It is an object of the present invention to provide an outer vent control device having a thermosensitive control valve that can be added to an existing outer vent control arrangement without the need of substantially redesigning the piping thereof, the thermosensitive control valve being operably dependent directly on the temperature of the carburetor float chamber.

Another object of the present invention is to provide a thermosensitive valve having a valve body which can be lifted quickly off a valve seat and which can provide an increased effective area of valve opening.

Still another object of the present invention is to provide a thermosensitive valve having a cover for shielding the thermosensitive unit from the adverse effects of the surrounding atmosphere and for preventing moisture from being condensed in the cover and also preventing air from being expanded in the cover.

According to the present invention, there is provided an outer vent control device for use between the float chamber of a carburetor for an engine and a canister through an outer vent line for delivering fuel vapor from the float chamber to the canister, the outer vent control device comprising a valve housing adapted to be attached to the outer wall of the float chamber in thermally conductive relation, the valve housing having an inlet port adapted to communicate with a float chamber vent port and an outlet port adapted to communicate with the outer vent line, a first control valve disposed in the valve housing and openable when the engine stops its operation, and a second thermosensitive control valve disposed in the valve housing and closable when the temperature of the float chamber drops below a preset temperature. The second thermosensitive control valve includes a thermosensitive unit and a cover attached to a valve housing thereof in covering relation to the thermosensitive unit. The second thermosensitive control valve further comprises a valve seat member disposed in the valve housing and having a valve seat, and a valve body movably disposed in the valve housing and seatable on the valve seat, the valve body having an upper conical surface facing the inlet port remotely from the valve seat. The cover has a ventilation hole defined in the bottom thereof at a lowermost position thereon.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
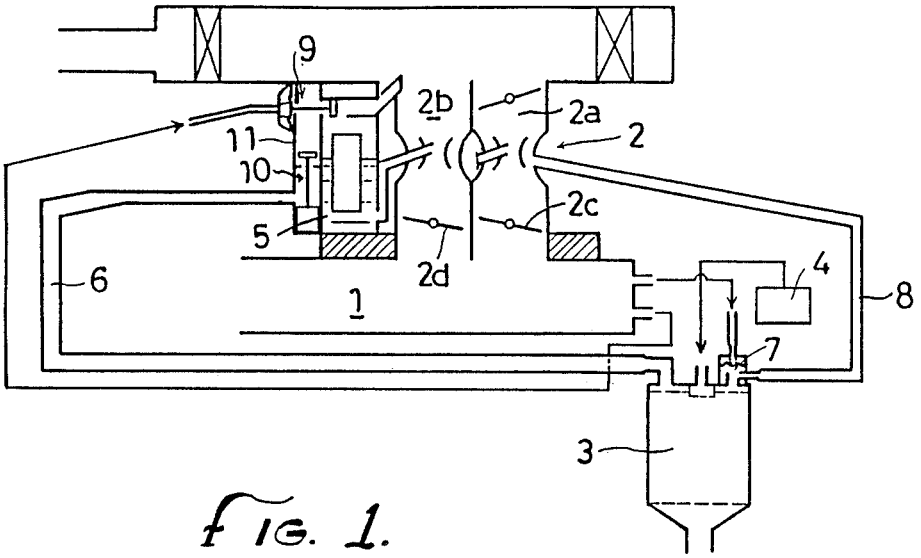
FIG. 1 is a schematic diagram of an outer vent control device according to the present invention, the outer vent control device being mounted on a carburetor.

FIG. 1 shows the general arrangement of an outer vent control device according to the present invention. The outer vent control device is combined with a carburetor 2 connected to an intake manifold 1 of an engine (not shown) and including a primary passage 2*a* and a secondary passage 2*b*, which have throttle valves 2*c*, 2*d*, respectively. A canister 3 is connected to a fuel tank 4 for adsorbing fuel vapor introduced from the fuel tank 4, and is also connected through an outer vent line 6 to a float chamber 5 of the carburetor 2 for adsorbing fuel vapor introduced from the float chamber 5. The adsorbed fuel vapor will be delivered from the canister 3 through a purge control valve 7 and a purge line 8 to the carburetor 2. The purge control valve 7 is opened in response to a vacuum developed in the intake manifold 1 when the engine is in operation.

The outer vent control device comprises a first control valve 9 openable when the engine is stopped in operation and a second thermosensitive control valve 10 closable when the engine is colder than a prescribed temperature. The first control valve 9 is closable in response to the vacuum in the intake manifold 1. The first and second control valves 9, 10 are accommodated in a valve housing 11 attached to the float chamber 5 and connected between the float chamber 5 and the outer vent line 6.

Figure 2:
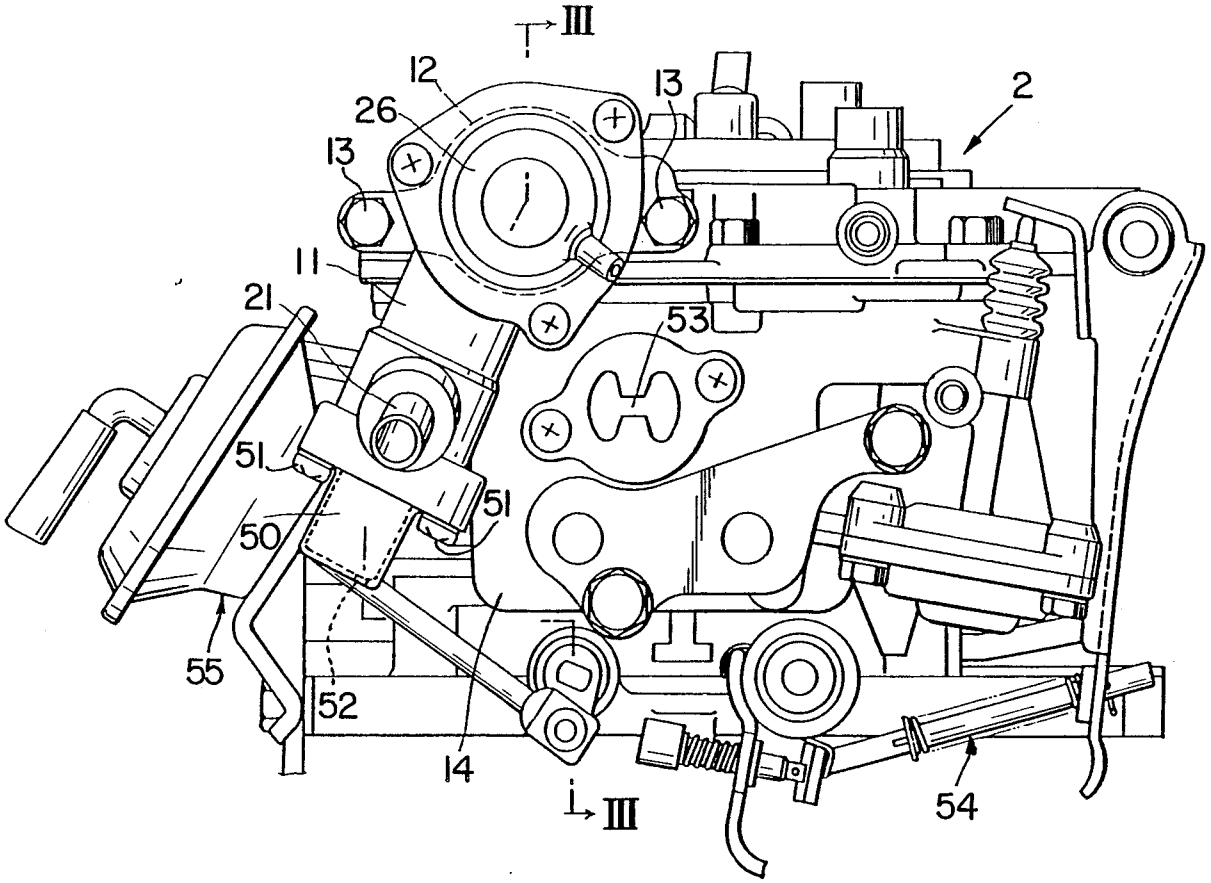
FIG. 2 is a front elevational view of the outer vent control device mounted on the carburetor.
Figure 3:
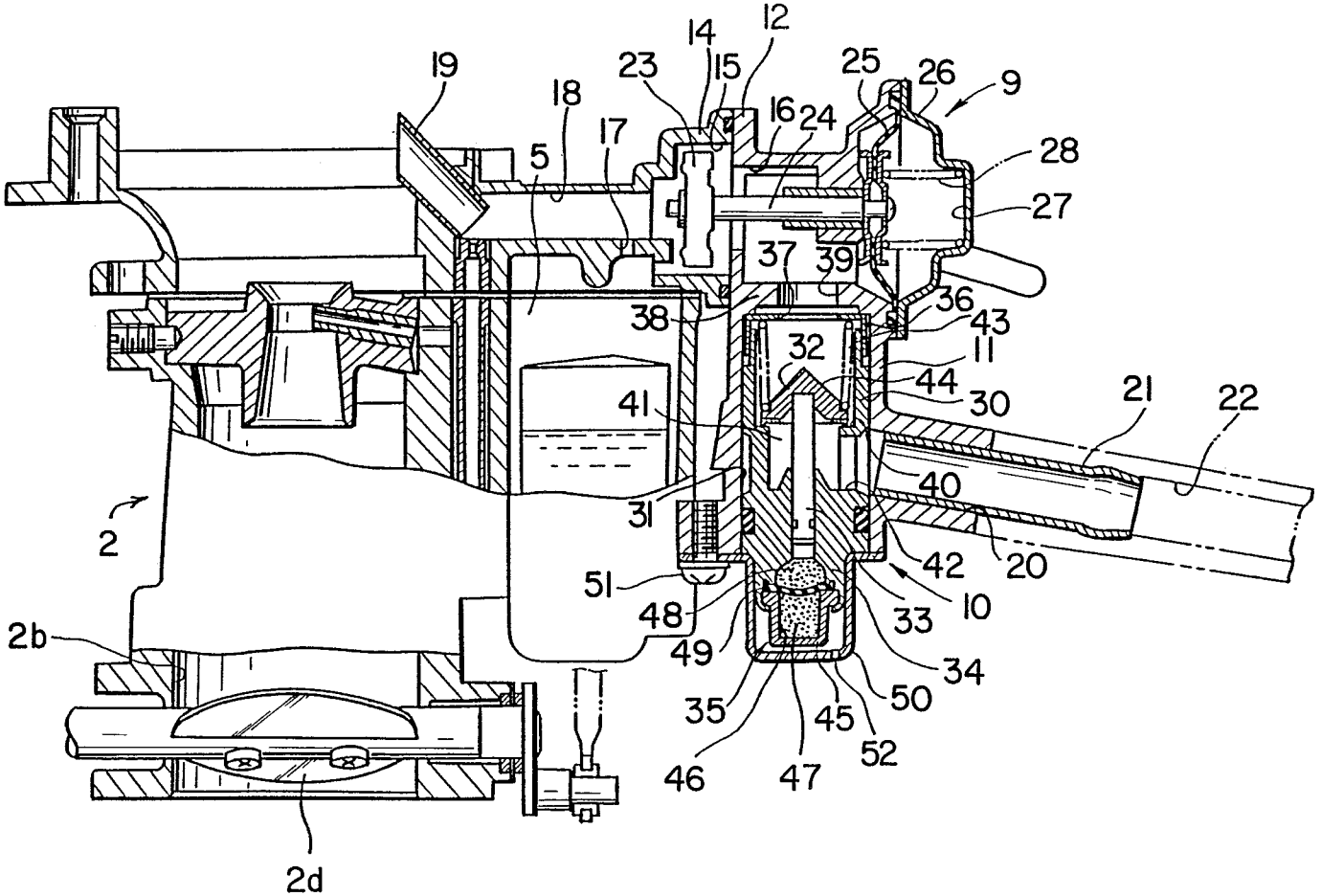
FIG. 3 is an enlarged fragmentary cross-sectional view taken along line III—III of FIG. 2.

As shown in FIGS. 2 and 3, the valve housing 11 has a flange 12 fixed by bolts 13 to the outer wall 14 of the float chamber 5 in thermally conductive relation. The valve housing 11 secured to the outer wall 14 is inclined with respect to the vertical direction, as illustrated in FIG. 2. The outer wall 14 of the float chamber 5 has a outer vent port 15 (FIG. 3) communicating with the float chamber 5. The valve housing 11 has an inlet port 16 surrounded by the flange 12 and held in communication with the outer vent port 15. The float chamber 5 also communicates through a hole 17 with an inner vent passage 18 connected to an inner vent 19 opening into the carburetor 2.

The inlet port 16 is defined in an upper inner side of the valve housing 11 which is of a vertically elongate tubular shape. The valve housing 11 also has an outlet port 20 defined in a lower outer side thereof. The first and second control valves 9, 10 are disposed respectively in upper and lower portions of the valve housing 11. In the outlet port 20, there is fitted a joint tube 21 connected to an end of a connector tube 22 with its opposite end coupled to the canister 3. The outer vent line 6 shown in FIG. 1 is composed of the joint tube 21 and the connector tube 22.

The first control valve 9 is in the form of a vacuum-operated valve comprising a valve body 23 movably disposed in the outer vent port 15 and mounted on an end of a rod 24 axially movably supported in the valve housing 11. The opposite end of the rod 24 is connected to a diaphragm 25 positioned outside of the valve housing 11. The diaphragm 25 and an outer cover 26 fixed to the valve housing 11 jointly define a vacuum chamber 27 communicating with the intake manifold 1 (FIG. 1). The diaphragm 25 is normally urged by a spring 28 in the vacuum chamber 27 in a direction to move the valve body 23 to the left, as shown in FIG. 3, to open the inlet port 16. When the engine is operated, a vacuum is developed in the vacuum chamber 27 to displace the diaphragm 25 against the force of the spring 28 for causing the valve body 23 to close the inlet port 16. While the engine is at rest, no vacuum is introduced into the vacuum chamber 27, and hence the valve body 23 is positioned away from the inlet port 16 to open the same under the bias of the spring 28.

Figure 4:
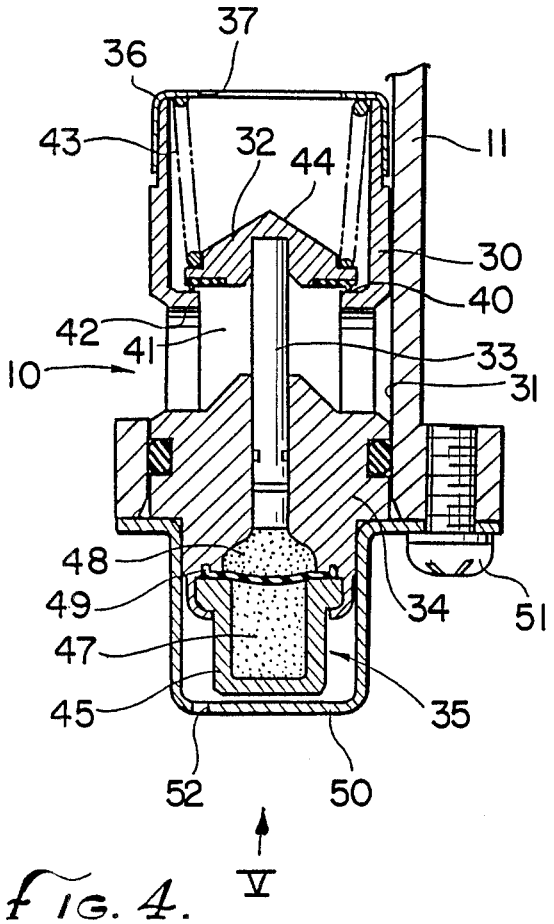
FIG. 4 is an enlarged longitudinal cross-sectional view of a thermosensitive control valve of the outer vent control device.

As illustrated in FIGS. 3 and 4, the second control valve 10 comprises a tubular valve seat body 30 disposed in a bore 31 defined in the valve housing 11, a valve body 32 movably disposed in the tubular member 31 and mounted on the upper end of a piston rod 33 slidably supported in a cylinder body 34 integral with the valve seat body 30 and fitted in the bore 31, and a thermosensitive unit 35 disposed on the lower end of the cylinder body 34. A cap 36 having a central hole 37 is fitted over the upper end of the tubular valve seat body 30 and held against an intermediate wall 38 having a central hole 39 communicating with the inlet port 16 and the central hole 37 of the cap 36. The tubular valve seat body 30 has an annular valve seat 40 on which the valve body 32 can be seated. The annular valve seat 40 surrounds a cavity 41 leading to a discharge port 42 defined between the valve seat body 30 and the cylinder body 34 and communicating with the outlet port 20. The valve body 32 is normally urged by a spring 43 to be seated on the valve seat 40 for thereby preventing communication between the inlet and outlet ports 16, 20. The valve body 32 has an upper conical surface 44 facing the central hole 37 of the cap 36.

The thermosensitive unit 35 has a cap 45 fixedly mounted on the lower end of the cylinder body 34. The cap 45, the cylinder body 34, and the lower end of the piston rod 33 jointly define a chamber 46 filled with a lower mass 47 of a thermowax and an upper mass 48 of semifluid that are separated by a diaphragm 49 retained in position by the cap 45. The semifluid mass 48 is held in contact with the lower end of the piston rod 33. The heat from the carburetor 2 is transmitted through the outer wall 14 of the float chamber 5, the flange 12 and the valve housing 11 to the cylinder body 34 and cap 45. This arrangement causes the second control valve 10 to be equal in temperature and responsive directly to the carburetor 2 and hence the float chamber 5. When the temperature of the carburetor 2 reaches a preset temperature, the semifluid mass 48 is melted and the thermowax mass 46 is expanded to displace the piston rod 33 axially upwardly for lifting the valve body 32 off the valve seat 40 against the resilient force of the spring 43, thereby providing communication between the inlet and outlet ports 16, 20. Therefore, when the engine is stopped and the carburetor temperature reaches the preset temperature, the fuel vapor from the float chamber 5 is delivered through the first and second control valves 9, 10 into the canister 3, in which the fuel vapor is adsorbed. The fuel vapor produced from the float chamber 5 at temperatures higher than the preset temperature when the engine is stopped is therefore prevented from being discharged into the atmosphere. When the carburetor temperature drops below the preset temperature while the engine is at rest, the thermowax mass 47 is contracted to allow the valve body 32 to be seated on the valve seat 40 under the biasing force of the spring 43 for thereby cutting off communication between the inlet and outlet ports 16, 20. Thus, the second control valve 10 is closed to prevent the fuel vapor from flowing from the float chamber 5 into the canister 3 at lower carburetor temperatures.

The thermosensitive unit 35 is covered with a cover 50 secured by screws 51 to the lower end of the valve housing 11. The thermosensitive unit 35 is therefore shielded by the cover 50 from the surrounding atmosphere for protection against adverse effects which would otherwise arise from direct contact with the surrounding atmosphere heated to a high temperature. Consequently, the thermosensitive unit 35 can operate precisely dependent on the carburetor temperature without being influenced by the high-temperature atmosphere within the engine compartment after the engine has been stopped. Additionally, the cover 50 serves to protect the thermosensitive unit 35 from damage which would otherwise result from being hit by a foreign object.

Figure 5:
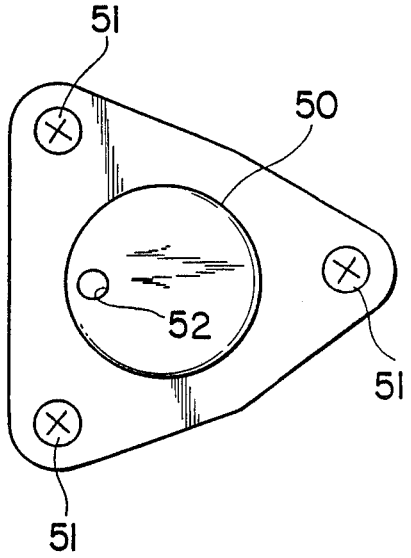
FIG. 5 is a bottom view of the thermosensitive control valve, as seen in the direction of the arrow V in FIG. 4.

As shown in FIGS. 4 and 5, the cover 50 has a ventilation hole 52 defined in the bottom at an off-center position thereon. The ventilation hole 52 is positioned such that it is in the lowermost position as shown in FIG. 2 when the valve housing 11 is attached obliquely with respect to the outer wall 14 of the float chamber 2. Since the ventilation hole 52 provides air ventilation in the space surrounded by the cover 50, normally no moisture will be condensed within the cover 50 even when there is a large temperature difference between the interior and exterior of the cover 50. However, even if moisture condensation occurs in the cover 50, the water will flow out of the cover 50 through the ventilation hole 52 as it is located in the lowermost position. Furthermore, the thermosensitive unit 35 is not subject to an air pressure buildup which would otherwise be developed within the cover 50 under a high temperature if there were no ventilation hole 52.

As shown in FIG. 2, a fuel level observation window 53 is attached to the outer wall 14 laterally of the inclined valve housing 11. The carburetor 2 has an accelerator-pump system (not shown) operated by a pump rod 54. The throttle valves *2c*, *2d* in the primary and secondary passages *2a*, *2b* are controlled by a valve control member 55.

The outer vent line 6 with the first and second control valves 9, 10 can easily be installed simply by attaching the single valve housing 11 to the outer wall 14 of the float chamber 5 and connecting the outlet port 20 to the canister 3 with the connector tube 22. Since the outer vent line piping can therefore easily be installed, the second control valve 10 can be added to an existing outer vent control arrangement having a first valve similar to valve 9 but no such second control valve without substantially redesigning the outer vent control arrangement.

The upper conical surface 44 of the valve body 32 serves to reduce the back pressure which is applied by the fuel vapor to the valve body 32 while the fuel vapor flows through the second control valve 10. The upper conical surface 44 also serves to reduce the resistance presented by the valve body 32 to the flow of the fuel vapor. As a result, the fuel vapor flows smoothly past the valve body 32 when it starts being lifted off the valve seat 40. The valve body 32 can thus be lifted quickly, and the effective area of valve opening at the time the second valve 10 is opened is increased.

Figure 6:
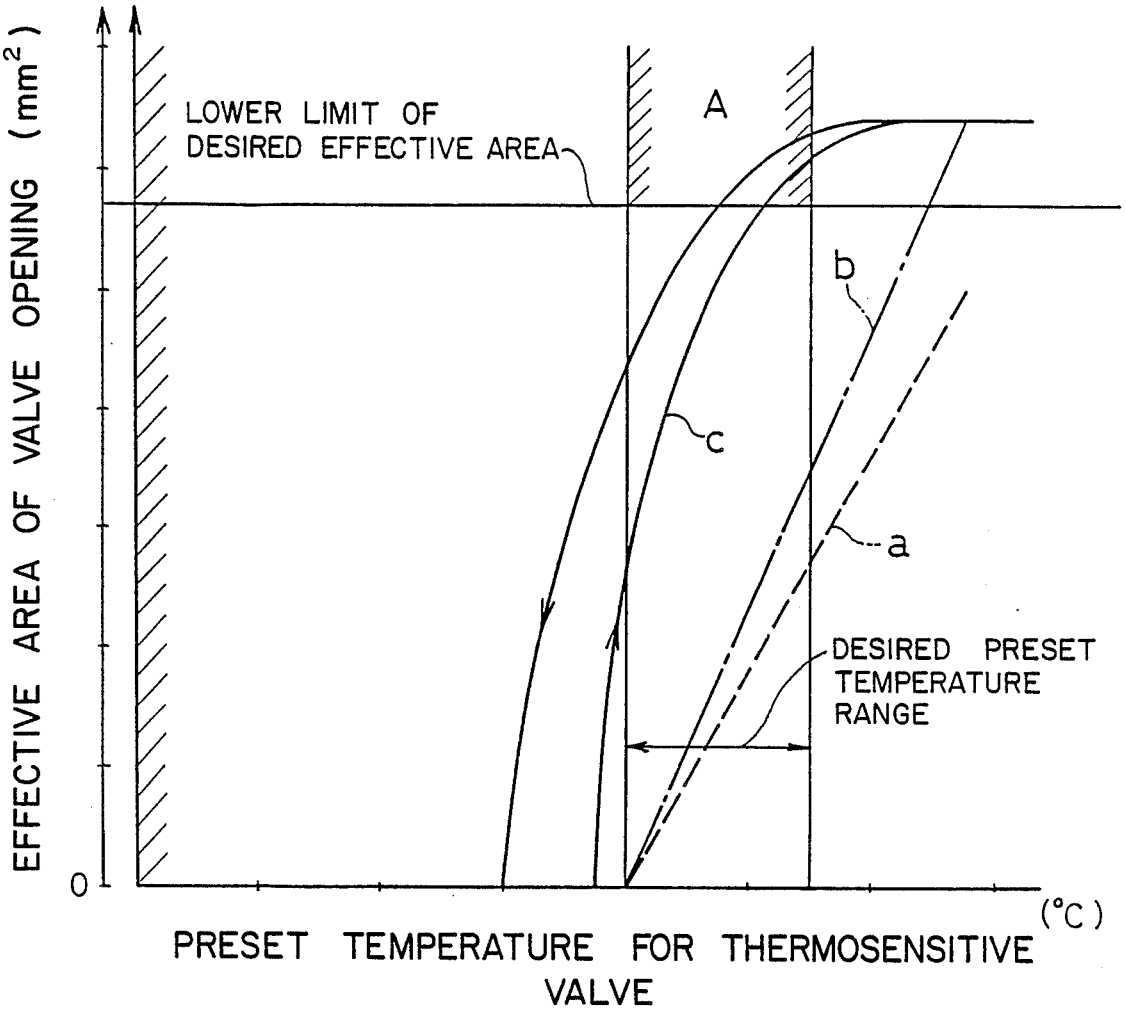
FIG. 6 is graph showing the relationship between the temperature setting and the effective opening area of the thermosensitive control valve.

FIG. 6 shows the relationship between the preset temperature for the thermosensitive control valve 10 and the effective opening area of the valve opening of the thermosensitive control valve 10, as confirmed by an experiment conducted by the inventors. The curve a indicates the characteristic of a conventional thermosensitive control valve, and the curve b indicates the characteristic of another conventional thermosensitive control valve having a larger inside diameter across the valve opening. The curve c represents the characteristic of the thermosensitive control valve of the invention which has the same inside diameter across the valve opening as that of the control valve indicated by the curve a. The curve c exhibits hysteresis in which the valve body 32 is lifted at a rate along a curve portion indicated by the upward arrow and is lowered at a rate along a curve portion indicated by the downward arrow. FIG. 6 indicates that the valve body 32 of the present invention is lifted more quickly than the conventional valve bodies, and covers the range A in which the desired effective opening area can be attained in a desired preset temperature range (for example, from 35° C. to 50° C.). As a consequence, the direct discharge of the fuel vapor from the float chamber into the atmosphere was reduced by the thermosensitive control valve of the present invention.

Although a certain preferred embodiment has been shown and described, it should be understood that many changes and modifications may be made therein without departing from the scope of the appended claims.

What is claimed:

1. An outer vent control device for use between a carburetor of an engine including a float chamber having an outer wall defining an outer vent port therein and a canister through an outer vent line for delivering fuel vapor from the float chamber to the canister, said outer vent control device comprising:

a valve housing adapted to be attached to the outer wall of the float chamber to provide a direct and continuous thermal conduction path therebetween, said valve housing having an inlet port adapted to communicate with the outer vent port and an outlet port adapted to communicate with the outer vent line;

a first control valve disposed in said valve housing and openable when the engine stops its operation; and a second thermosensitive control valve disposed in said valve housing and closable when the temperature of the float chamber drops below a preset temperature.

2. An outer vent control device for use between a carburetor of an engine including a float chamber having an outer wall defining an outer vent port therein and a canister through an outer vent line for delivering fuel vapor from the float chamber to the canister, said outer vent control device comprising:

a valve housing adapted to be attached to the outer wall of the float chamber in thermally conductive relation, said valve housing having an inlet port adapted to communicate with the outer vent port and an outlet port adapted to communicate with the outer vent line;

a first control valve disposed in said valve housing and openable when the engine stops its operation; and a second thermosensitive control valve disposed in said valve housing and closable when the temperature of the float chamber drops below a preset temperature, said valve housing being an elongate tubular shape having said inlet port in an upper portion thereof and said outlet port in a lower portion thereof, said first control valve being disposed in said upper portion of the valve housing, said second thermosensitive control valve being disposed in said lower portion of the valve housing, said second thermosensitive control valve including a thermosensitive unit on a lower end thereof and a cover attached to said valve housing in covering relation to said thermosensitive unit.

3. An outer vent control device for controlled venting fuel vapors from a float chamber of an engine carburetor to a canister, comprising, a valve housing adapted to be connected to the carburetor float chamber and having an inlet communicating with the float chamber and an outlet for communicating with the canister, said valve housing being in direct and continuous thermally conductive relation with the float chamber, and a thermosensitive control valve positioned in said valve housing in direct and continuous thermally conductive relation therewith and having means for closing a valve means below a predetermined temperature of the float chamber to prevent communication between said inlet and outlet.

4. An outer vent control device according to claim 2, wherein said second thermosensitive control valve further includes a valve seat member disposed in said valve housing and having a valve seat, and a valve body movably disposed in said valve housing and seatable on said valve seat, said valve body having an upper conical surface facing said inlet port remotely from said valve seat.

5. An outer vent control device according to claim 2, wherein said cover has a ventilation hole defined in the bottom thereof at a lowermost position thereon.

6. An outer vent control device according to claim 1, wherein said second thermosensitive control valve includes a thermosensitive unit for operating said second thermosensitive control valve and means in thermally conductive relation between said valve housing and said thermosensitive unit for subjecting said thermosensitive unit to substantially the temperature of the carburetor float chamber.

* * * * *